US007111569B1

(12) United States Patent
Sanders

(10) Patent No.: US 7,111,569 B1
(45) Date of Patent: Sep. 26, 2006

(54) INDIVIDUAL PROPELLED WATER CRAFT

(76) Inventor: Roy F. Sanders, 9512 Hopeland, Austin, TX (US) 78749

( * ) Notice: Subject to any disclaimer, the term of this patent is extended or adjusted under 35 U.S.C. 154(b) by 0 days.

(21) Appl. No.: 11/139,939

(22) Filed: May 27, 2005

(51) Int. Cl.
*B63B 1/00* (2006.01)

(52) U.S. Cl. ..... 114/61.2; 114/288; 441/65

(58) Field of Classification Search ..... 114/61.1, 114/61.2, 219, 288, 364, 61.21; 427/386; 428/138; 440/101; 441/44, 45, 65, 74
See application file for complete search history.

(56) References Cited

U.S. PATENT DOCUMENTS 2,959,146 A * 11/1960 Erkert ..... 114/219
4,192,249 A * 3/1980 Vidal ..... 114/61.21
4,295,236 A * 10/1981 Upchurch ..... 114/61.1
4,318,700 A * 3/1982 Price ..... 114/61.1
4,361,614 A * 11/1982 Moffitt, Jr. ..... 428/138
5,284,682 A * 2/1994 Martin ..... 427/386
5,365,869 A * 11/1994 Bulgarini ..... 114/61.2
5,529,008 A * 6/1996 Craig ..... 114/61.1
6,022,255 A * 2/2000 Lukanovich ..... 440/101
6,085,677 A * 7/2000 Bell ..... 114/61.1

* cited by examiner

*Primary Examiner*—Lars A. Olson
(74) *Attorney, Agent, or Firm*—Buskop Law Group, P.C.; Wendy Buskop

(57) ABSTRACT

An individual propelled catamaran watercraft with sloping sides and sloping channel adapted for supporting an individual without flipping and having a draft of no more than 3 inches.

13 Claims, 3 Drawing Sheets

INDIVIDUAL PROPELLED WATER CRAFT

FIELD

The present embodiments relate generally to a lightweight floating vessel for fishing and repair of bridges and other floating structures. The lightweight floating vessel enables a person to stand on the vessel without flipping over during poling, paddling, fishing and other activities.

BACKGROUND

Fishing boats traditionally are standard monohull designs, such as those used for bass boats, Boston Whalers™ or standard rowboats. With a monohull designs, fishermen cannot stand up in the boat without flipping over the boat or simply falling out of the boat.

A need exists for a safer boat with a different hull design in which a fisherman can stand up in during fishing.

Metal bass boats, and wooden boats and thick hulled fiberglass boats, like Boston Whalers' are also heavy, and require at least two people to lift the boat onto a car top due to the weight. Boston Whalers can only be trailered because they are heavy. A need exists for a lightweight boat that can be car topped, and be safe for fishing while standing up.

Traditional fishing boats use a draft of between 6 inches and 20 inches, such as Boston Whalers. A need has existed for a fishing vessel, or similar vessel which can float over endangered plant life, such as sea grass in Florida, with a draft of only a few inches without harming the plant life, yet enable a fisherman to stand up on the craft, safely without flipping over.

The present embodiments meet these needs.

BRIEF DESCRIPTION OF THE DRAWINGS

The detailed description will be better understood in conjunction with the accompanying drawings as follows.

Figure 1:
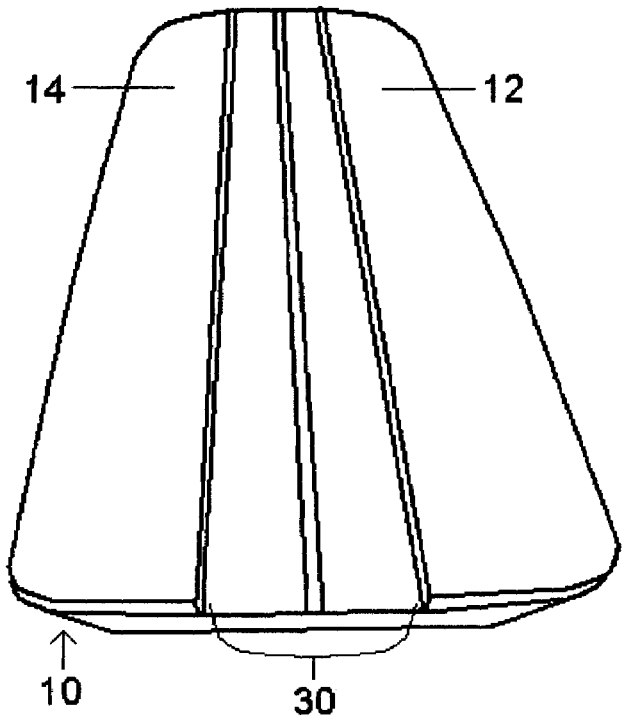
FIG. 1 depicts a bottom perspective view of an embodiment of the watercraft.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that the invention can be practiced or carried out in various ways.

The present embodiments relate to a watercraft that enables a person or two persons weighing up to a collective weight of 500 pounds to paddle or pole from a standing position for fishing or for repairs of other floating structures while only requiring a draft of a few inches. The watercraft is used for shallow draft due to the lightweight catamaran design.

The catamaran watercraft has a tapered water channel formed in the bottom of the vessel for increased stability in order to allow person(s) to stand on the watercraft without tipping the vessel. The watercraft can be 10 feet to 20 feet in length. Watercrafts with lengths of 10.5 feet, 14 feet, 16 feet, and 18 feet are well adapted for commercial lengths.

The watercraft can be formed from foam or from blow molded plastic or fiberglass molding. The watercraft is formed from cut foam blocks of expanded polystyrene (EPS) foam. The size of the foam block to start construction is typically 48 inches wide, 4 inches thick, and 14 feet long.

EPS foam is a closed cell, lightweight and resilient, foamed plastic composed of hydrogen and carbon atoms. EPS's mechanical strength changes based on the density of the foam. EPS foam is particularly usable for the embodied watercraft because the material is resistant to compressive stresses. For example, the compressive stress of the EPS foam increases as the density becomes higher. EPS foam has a compressive resistance between 10 psi and 60 psi. The ASTM C578, Standard Specification covers the types, physical properties, and dimensions of cellular polystyrene.

The following show the typical strengths characteristics for EPS foam board from ASTM test C 578 for compression and flexural strength resistance.

| | | ASTM | ASTM C578 Type | | | |
|---|---|---|---|---|---|---|
| Property | Units | Test | I | VIII | II | IX |
| Density Range | pcf | C303 | 0.90–1.14 | 1.15–1.34 | 1.35–1.79 | 1.80–2.19 |
| Flexural Strength | psi | C203 | 25–30 | 32–38 | 40–50 | 55–75 |
| Compressive Resistance | psi | C165 or D1621 | 10–14 | 13–18 | 15–17 | 25–33 |

EPS foam is typically used for thermal insulation and not to manufacture watercraft. The flexural strength and compressive resistance values of the EPS foam suggests that the material is unlikely to be used for uses where banging or bumping occurs. The construction of a watercraft using this material is unexpected because the watercraft experiences regular impacts, such as a boat hitting a dock.

The use of EPS foam on a watercraft allows the watercraft to sustain temperature changes and small structural deflections. The EPS foam provides an effective load distribution for the top surface of the watercraft without experiencing cracking. The EPS foam allows the watercraft to resist water without affecting the mechanical strength characteristics of the EPS foam. The EPS foam allows the watercraft to absorb a coating, such as blue paint in order to deceive fish.

With reference to the figures, FIG. 1 depicts a bottom view of an embodiment of a watercraft (10). The watercraft can be form as a one-piece of construction or as a two-piece construction. Embodiments with more than two pieces are possible, if necessary. The figures depict the two-piece construction.

As shown in FIG. 1, the bottom side of an embodiment of the watercraft (10) includes a starboard side float (12) and a port side float (14). The tapered or graduated channel (30) is shown between the two floats (12 and 14). The floats (12 and 14) include sloped edges to cause the water craft to float on the water. The watercraft requires very little draft. For example, the watercraft can use only three inches of draft, thereby making the watercraft usable in the shallowest of bodies of water of just a few inches.

Figure 2:
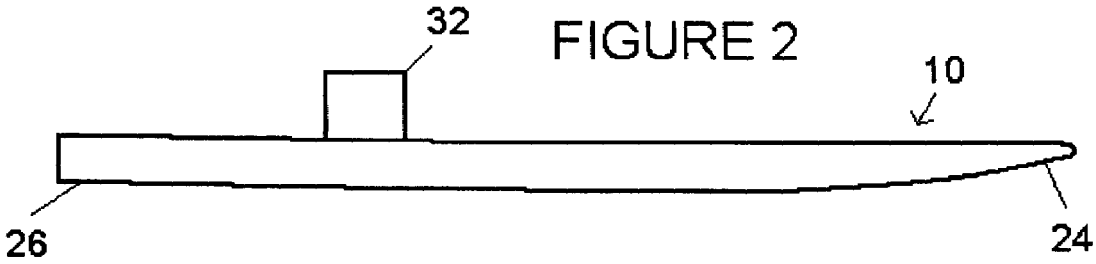
FIG. 2 depicts a side view of an embodiment of the watercraft.

FIG. 2 depicts is a side view of an embodiment of the watercraft (10). FIG. 2 examples a sloped bow (24) and a flat bottom stern (26). The watercraft allows a person to stand on top of the watercraft, wherein the watercraft remains steady. The watercraft is steady so that the person on the boat can cast a fishing line without worrying about tipping the boat or falling into the water The watercraft (10) can be equipped with a seat (32). The seat (32) can be attached to the water craft in numerous manners, such as bungee cords and fasteners. The seat (32) can also be an insulated container to items, such as food, drinks, or caught fish. The seat (32) can be constructed from the EPS foam and still be strong enough to support the weight of an individual. The watercraft can include rails on which a seat can be placed.

Figure 3:
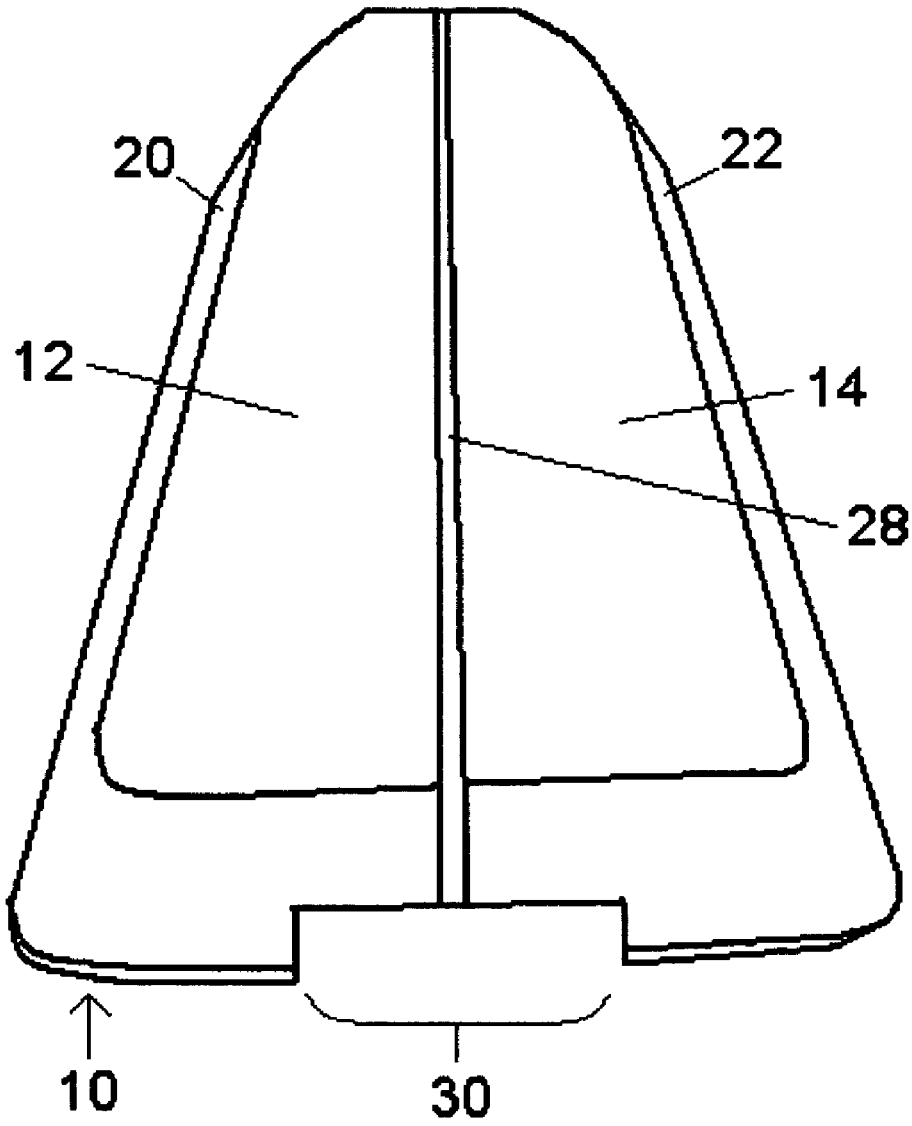
FIG. 3 depicts a top perspective view of an embodiment of the watercraft.

FIG. 3 depicts a top view of an embodiment of the watercraft (10). The first and sloping edges (20 and 22) are exampled in the figure. In the two-piece construction, a connection strut (28) is placed in the channel (30) between the two floats (12 and 14). The connection strut (28) for connects the floats (12 and 14) and maintains the floats (12 and 14) in a spaced apart parallel configuration. The connection strut includes a glue or a sealant, such as polyurethane.

A stringer core is located in the connection strut (28). The stringer core provides longitudinal stability. The stringer core can be made of cedar, spruce, other strong, but flexible woods. The polymer stringer core can be PVC polymer. In a one-piece construction, a deep channel is formed in the EPS foam to allow the stringer core to be inserted. The channel is then filled with a glue or sealant, such as polyurethane.

Figure 4:
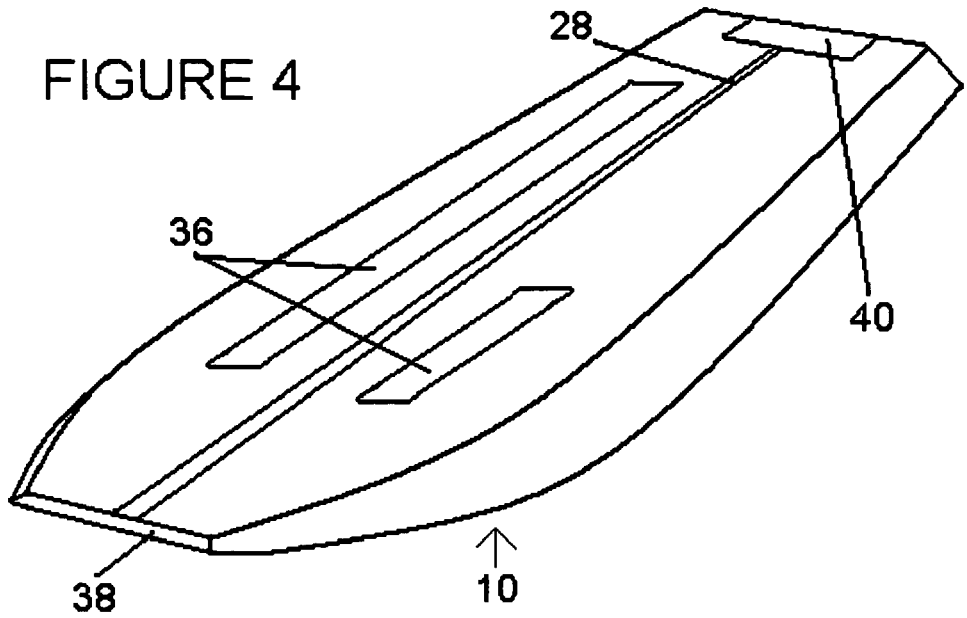
FIG. 4 depicts a perspective view of the bow of an embodiment of the watercraft.

FIG. 4 depicts a perspective view of the top side of an embodiment of the watercraft (10). The watercraft (10) can include a non-skid surface (36). The non-skid surface (36) can be rubber or other material in order to keep the user from slipping the surface of the watercraft (10). The non-skid surface (36) can cover the entire surface or can be placed in specific areas as shown in FIG. 4.

The embodied watercraft (10) can include a bumper (38) to prevent damage to the watercraft (10). FIG. 4 depicts the bumper (38) located on the bow only, but a bumper can placed on the stern and sides as well.

The embodied watercraft (10) can include a trolling motor (not shown) attached to the watercraft (10) by a trolling motor mount (40). FIG. 4 depicts the trolling motor mount (40) secured to the stern of the watercraft (10), but the trolling motor mount (40) can be located on sides or the bow of the watercraft (10).

The embodied watercraft (10) can be powered by use of oar or pole in shallow water. The oar can have a collapsible handle with two paddles, thus making the oar an adjustable dual paddle oar. The oar can be attached the watercraft (10) by use of a T-that can be in a threaded engagement in the body of the watercraft (10).

The embodied watercraft (10) can have one or more floundering lights secured to the body and powered by an energy source, such as a fuel cell. A gig can be secured to one or more of the floundering lights.

Figure 5:
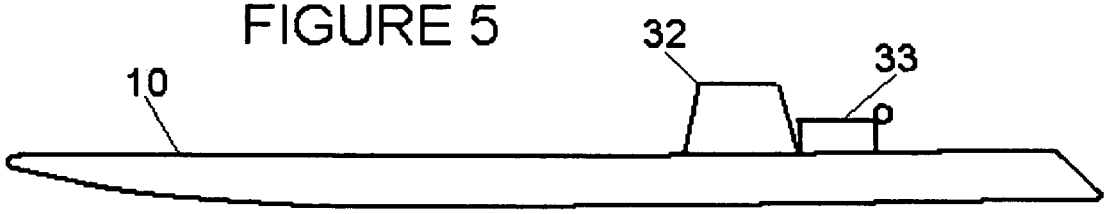
FIG. 5 is a view of the seat and basket disposed on the watercraft.

FIG. 5 shows an embodiment of the watercraft (10) with a different form of seat (32) and a basket (33) or storage box secured behind the seat (32) for holding material of the individual, such as fishing gear, an anchor, lines, bait, an oar, or other items.

The following is an example of construction of an embodiment of watercraft (10). Initially, a large EPS foam block is cut forming two pieces—a first piece 36"×4"×14' and a second piece 12"×4"×14'. Larger watercrafts begin construction with large blocks and smaller watercrafts start with small blocks. The small watercrafts are more suitable for one-piece construction. The only limitation is the availability of sizes of the EPS foam block. The first piece is cut forming two rectangles, each 18"×4"×14'. The second piece is cut forming two more rectangles, each 2"×12"×14'.

A stringer core is placed in the middle between the first half and the second half on the cut sides. The first half and the second half are glued together with the stringer core in the center forming a top hull portion. The third half and the fourth half are then glued to the bottom of the first and second halves.

A second stringer core is placed in the middle between the third half and the fourth half on the cut sides. The third half and the fourth half are glued together, forming a bottom hull portion. A hot wire can be used to cut the channel to form the compression channel.

A tapered channel is formed. The tapered channel is about 2 inches deep at the stern and taper to the bow for a 14 foot craft. For longer watercrafts, the channel can be slightly deeper at the stern and taper to the bow. The channel is formed to be wider at the bow of the vessel forming a graduated channel that compresses water into a more confined space. By compressing the water, the compressed water in the hull acts as a rudder to provide directional stability. The compressing water in the hull works like a fin without needing a fin. The directional stability allows the embodied watercraft to be poled or oared in a straight line, in contrast to other watercrafts of a catamaran style that veer off a course by at least 10 degrees. The directional stability is accomplished in the embodied watercraft by hull design.

Once the graduated channel is formed, the top of the hull formed by cutting the foam with a hot wire against a template, thereby forming a slope. A first and a second side template are created and are placed on either side of the foam. The templates act as guides for the hotwire to make cutting faster and easier. The watercrafts, in turn, are faster, easier, and thereby cheaper to manufacture. The hotwire with template cuts the slope in the bottom of the bow.

The slope is formed ranging from about 4 foot in length from a 4 inch thickness in the foam to a 2 inch thickness in the foam. The slope can be a 3-foot long slope in smaller watercrafts and still form a usable, stable watercraft. The slope can be longer in larger watercrafts. The thickness of the foam is kept at least 2 inches to ensure the ability of the watercraft to sustain impact, such as with a dock or a bridge or a trailer.

Two more templates are formed, essentially a third and a fourth template. The third template is a top template and the fourth template is the bottom template. A hotwire is used to form a slope from the top of the floats to the bottom. As an example, the slope reduces the width of the assembled floats from an original thickness of 36 inches to a thickness of 28 inches. The slope is approximately between a 30 to 40 degrees slope, measured from top to bottom.

The templates are removed. The sides of the watercraft are smoothed using a tool, such as a plane or shurform. The sides are cut so that the flats are square to the surface of the water. The flat design provides impact resistance and prevents fracturing of the hull design so that water flows easier through the channel.

An epoxy resin with microbeads, such as of fiberglass, is painted over the entire craft to seal any indentions, holes, and irregularities. The epoxy resin makes the watercraft smooth. The resin is cured for until hard. Examples of usable resins include polyamide epoxy resins available from Resin Research epoxy system. Another example of resin is polyester.

Fiberglass cloth is laid over the epoxy resin, and more epoxy resin is applied to the cloth over the entire vessel. The assemblage is allowed to cure again. The step of adding fiberglass can be done in segments or all at once, if the watercraft is supported. Materials other than fiberglass cloth can be used, such as graphite, Kevlar, PVC, or bamboo, to achieve the same effect.

Paint can be sprayed on the fiberglass to give a smooth, coating that can resist dirt and barnacle build up, if the vessel is left in salt water. Nonskid decking, such as a rubber mat, can be secured to the deck. Additionally, cleats or small hooks can be used to provide mounts for bungee cords, which are used to hold the seat to the craft.

The embodiments have been described in detail with particular reference to certain preferred embodiments, thereof, but it will be understood that variations and modifications can be effected within the scope of the embodiments, especially to those skilled in the art.

What is claimed is:

1. An individual propelled watercraft comprising:

a. a starboard float comprising a starboard sloped edge, a first sloped bow, a first flat bottomed stern, and a first stringer core;

b. a port float comprising a port sloped edge, a second sloped bow, a second flat bottomed stern, and a second stringer core;

c. a connection strut to connect the starboard float and the port float, thereby forming a single-hulled individual propelled watercraft, wherein the single-hulled individual propelled watercraft has a water draft of less than 3 inches; and d. a graduated channel having a substantially uniform width from bow to stern between the starboard float and the port float, wherein the graduated channel maintains the starboard float and the port float at a spaced apart parallel configuration.

2. The water craft of claim 1, wherein the starboard float and the port float further comprise an epoxy coating.

3. The water craft of claim 1, wherein the starboard float and the port float further comprise a bumper located around the floats.

4. The watercraft of claim 1, wherein the starboard float and the port float each comprise a top width of 28 inches and a bottom width of 34 inches.

5. The watercraft of claim 1, wherein the starboard float and the port float are composed of a foam.

6. The watercraft of claim 5, wherein the foam is an expanded polystyrene foam.

7. The watercraft of claim 1, further comprising a scat.

8. The watercraft of claim 1, further comprising a non-skid surface.

9. The watercraft of claim 8, wherein the non-skid surface is a rubber mat.

10. The watercraft of claim 1, further comprising an elongated adjustable dual paddle oar attachable to the individual propelled watercraft.

11. The watercraft of claim 10, wherein the oar further comprises a removable T-handle that engages an end of the oar.

12. The watercraft or claim 10, wherein the oar comprises a removable stub root that engages an end of the oar.

13. The watercraft of claim 1, further comprising a bracket adapted to attach a trolling motor.

* * * * *